US011805848B1

(12) United States Patent
Kramer

(10) Patent No.: US 11,805,848 B1
(45) Date of Patent: Nov. 7, 2023

(54) FOLDABLE SHOE

(71) Applicant: Bruce Kramer, Raleigh, NC (US)

(72) Inventor: Bruce Kramer, Raleigh, NC (US)

( * ) Notice: Subject to any disclaimer, the term of this patent is extended or adjusted under 35 U.S.C. 154(b) by 0 days.

(21) Appl. No.: 17/885,650

(22) Filed: Aug. 11, 2022

(51) Int. Cl.
*A43B 3/24* (2006.01)

(52) U.S. Cl.
CPC ..... *A43B 3/248* (2013.01); *A43B 3/24* (2013.01)

(58) Field of Classification Search
CPC .. A43B 3/12; A43B 3/126; A43B 3/10; A43B 3/101; A43B 3/102; A43B 3/248; A43B 3/24
USPC ..... 36/100, 11.5
See application file for complete search history.

(56) References Cited

U.S. PATENT DOCUMENTS 5,787,608 A * 8/1998 Greenawalt ..... A61F 5/14 36/169
7,168,190 B1 * 1/2007 Gillespie ..... A43B 3/24 363/31
2006/0075656 A1 * 4/2006 Januszewski ..... A43B 3/122 36/11.5
2010/0018080 A1 * 1/2010 Smith ..... A43B 3/24 36/102
2011/0214312 A1 * 9/2011 Krikelis ..... A43B 3/248 36/43
2011/0225850 A1 * 9/2011 Shen ..... A43B 23/0245 36/136
2013/0036630 A1 * 2/2013 Gavrieli ..... A43B 3/248 36/102
2013/0255105 A1 * 10/2013 Bishop ..... A43B 7/28 36/25 R
2014/0123517 A1 * 5/2014 Chen ..... A43B 3/248 36/102
2014/0373396 A1 * 12/2014 Chang ..... A43B 13/141 36/30 R
2017/0156435 A1 * 6/2017 Al Nawab ..... A43B 3/128
2017/0172256 A1 * 6/2017 Ganci ..... A43C 11/1493
2017/0224054 A1 * 8/2017 Zeng ..... A43B 23/0255
(Continued)

*Primary Examiner* — Marie D Bays
(74) *Attorney, Agent, or Firm* — Daniel Becker, Attorney at Law, PLLC.

(57) ABSTRACT a foldable shoe, comprising: a sole extending between a toe end and heel end, the sole comprising a toeroom region proximate the toe end and a heel region proximate the heel end and a midfoot region defined between the toeroom region and heel region, the toeroom region comprising a strap spanning the width of the shoe in a toe-lever region of the toeroom region, the heel region comprising at least one strap retainment recess, configured to alternately: receive the strap and retain the strap against slipping off of the sole and mitigate stress concentrations against breakage under the tensile strength of the strap and bending strength of the sole, when the shoe is folded; and define the compression strength of the sole in the heel region, such that the shoe is configured to alternately: receive a foot of a user with a ball of the user's foot retained in the midfoot region with a stretchable upper portion of the shoe that is independent of the strap; and fold into a retainment orientation, with the heel region retained in a parallel offset orientation to the toeroom region with the strap, with the upper portion contained between the toeroom region of the sole and the heel region of the sole, with the strap traversing under the sole in the heel region and retained in the strap retainment recess.

9 Claims, 6 Drawing Sheets

(56) References Cited

U.S. PATENT DOCUMENTS

| | | | | |
|---|---|---|---|---|
| 2020/0107605 | A1* | 4/2020 | Anderson | A43B 3/128 |
| 2022/0264988 | A1* | 8/2022 | Dong | A43B 3/101 |

* cited by examiner

FOLDABLE SHOE

TECHNICAL FIELD

The present invention is relevant to the fields of footwear and folding footwear.

SUMMARY

The presently disclosed subject matter is a foldable shoe.

Generally, the present invention comprises at least embodiments related to devices for serving as shoes which are able to fold. Specifically, the present invention comprises embodiments of a device for serving as footwear that can be folded and unfolded into a more compact shape.

According to an aspect, a foldable shoe, comprising: a sole extending between a toe end and heel end, the sole comprising a toeroom region proximate the toe end and a heel region proximate the heel end and a midfoot region defined between the toeroom region and heel region, the toeroom region comprising a strap spanning the width of the shoe in a toe-lever region of the toeroom region, the heel region comprising at least one strap retainment recess, configured to alternately: receive the strap and retain the strap against slipping off of the sole and mitigate stress concentrations against breakage under the tensile strength of the strap and bending strength of the sole, when the shoe is folded; and define the compression strength of the sole in the heel region, such that the shoe is configured to alternately: receive a foot of a user with a ball of the user's foot retained in the midfoot region with a stretchable upper portion of the shoe that is independent of the strap; and fold into a retainment orientation, with the heel region retained in a parallel offset orientation to the toeroom region with the strap, with the upper portion contained between the toeroom region of the sole and the heel region of the sole, with the strap traversing under the sole in the heel region and retained in the strap retainment recess.

BRIEF DESCRIPTION OF THE DRAWINGS

Figure 1A:
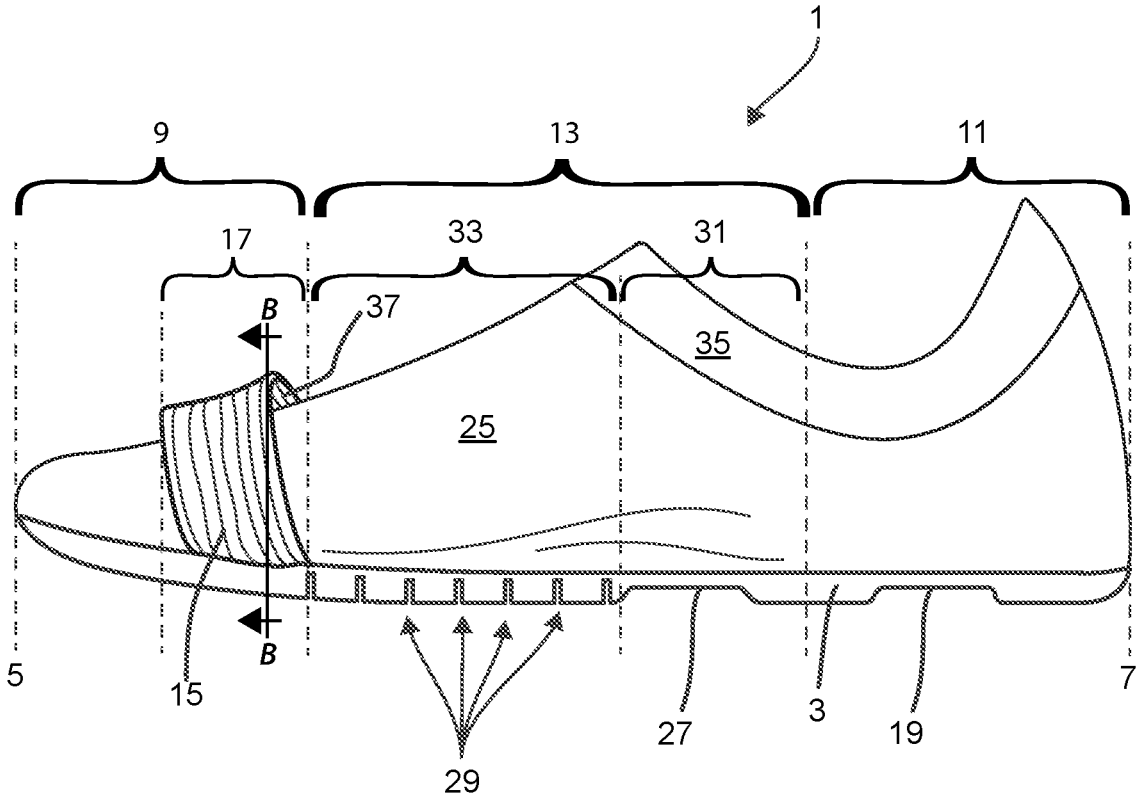
Figure 1B:
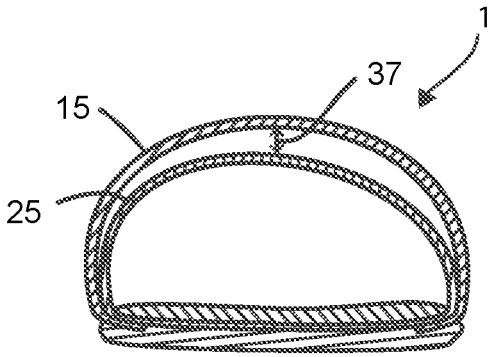
Figure 2A:
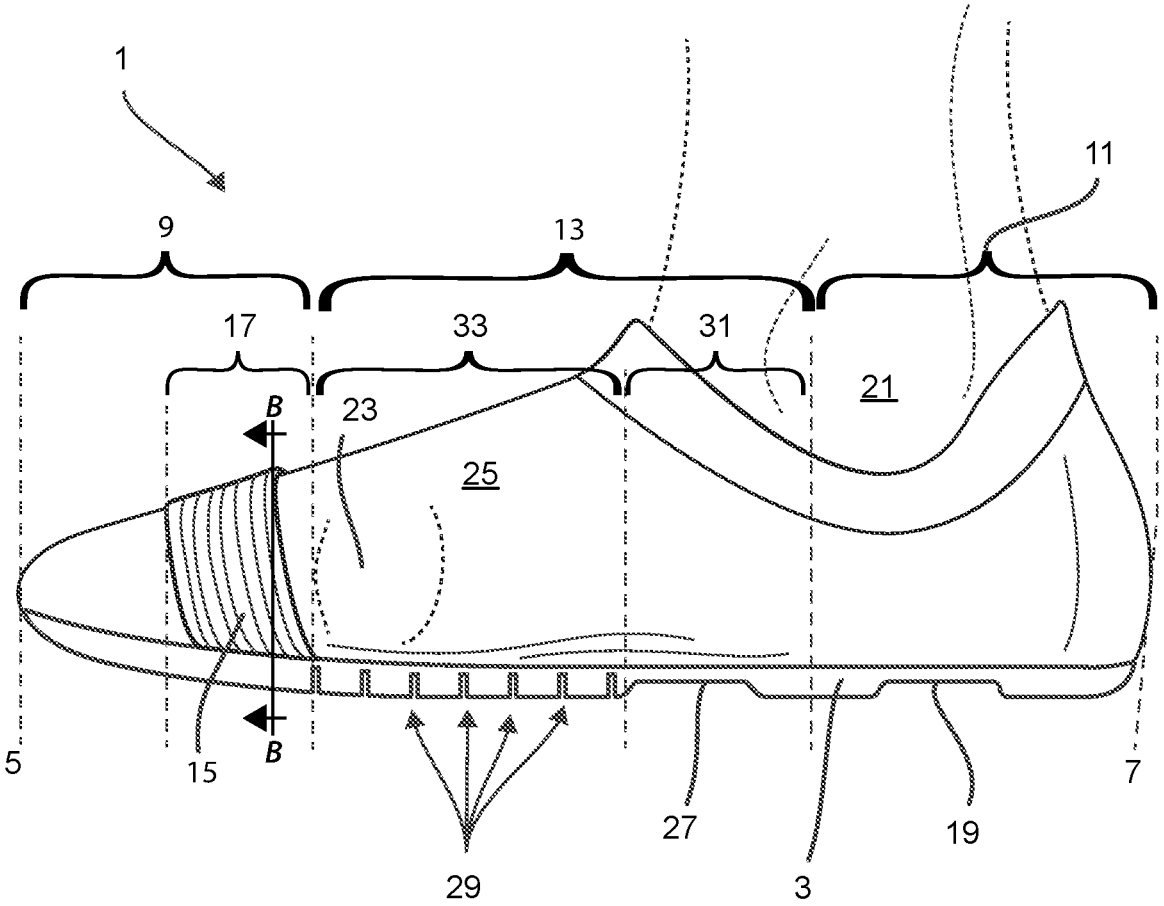
Figure 2B:
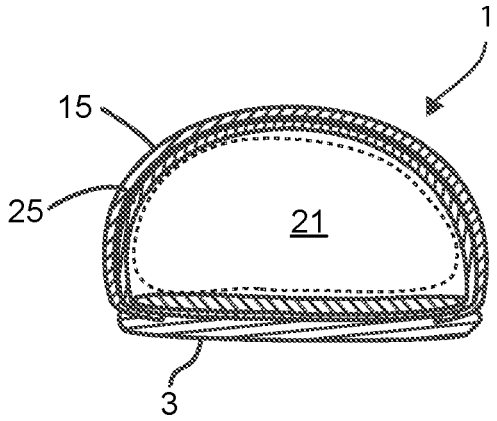
Figure 3:
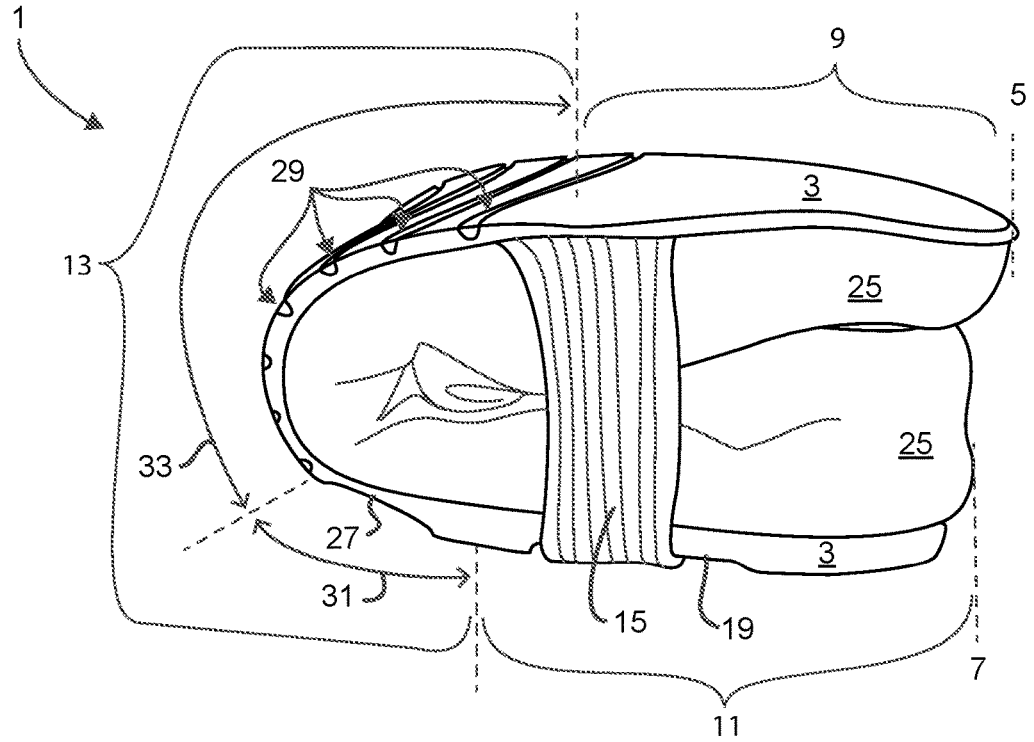
Figure 4:
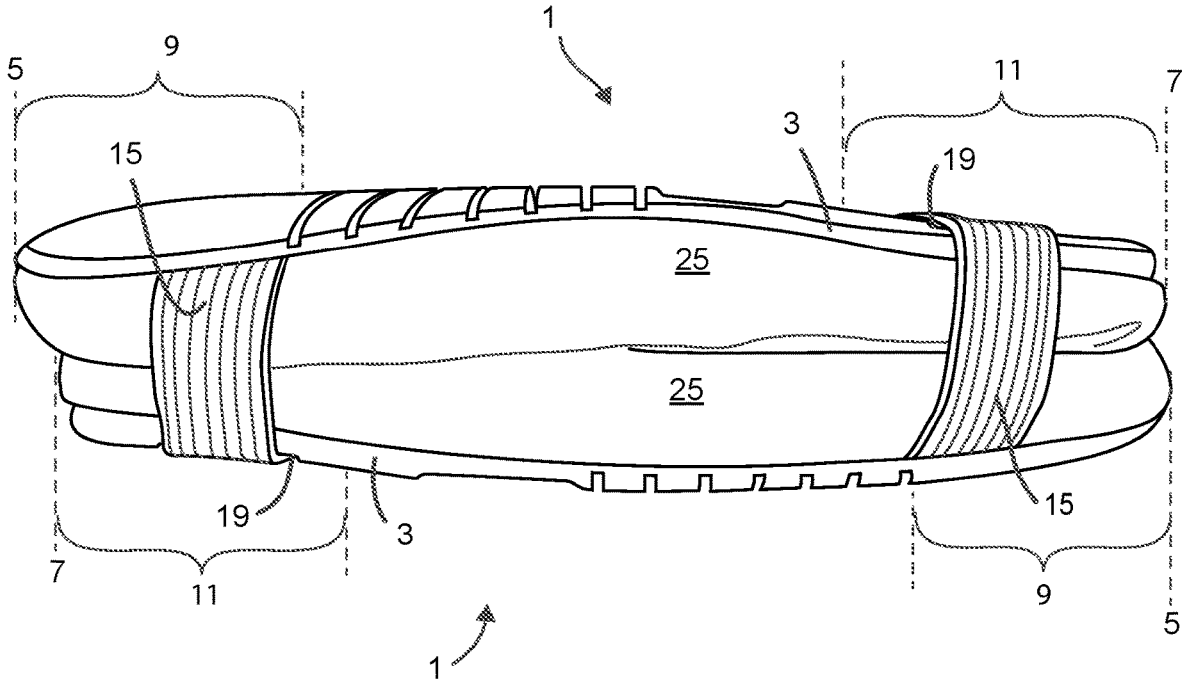
Figure 5A:
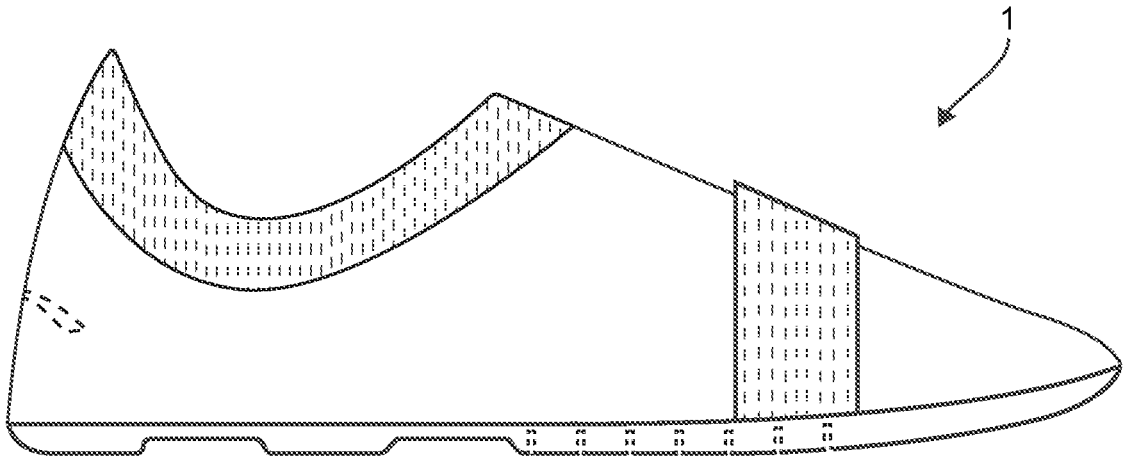
Figure 5B:
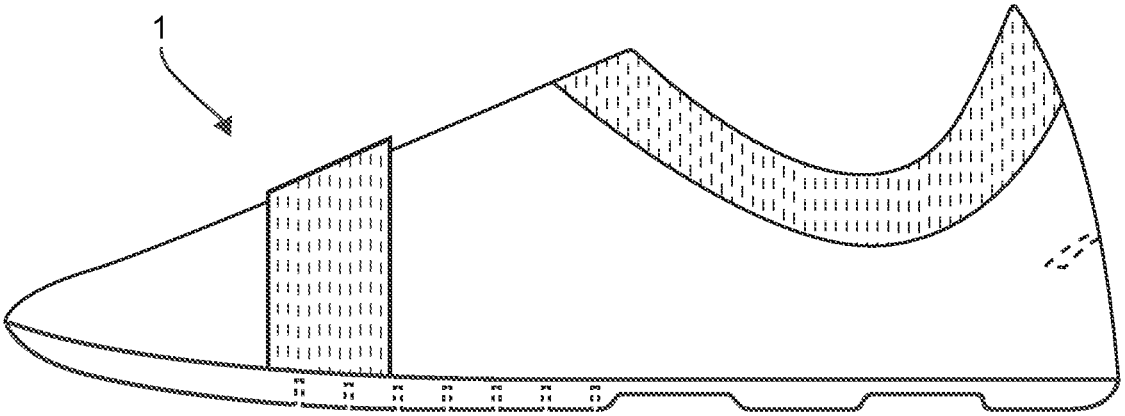
Figure 6:
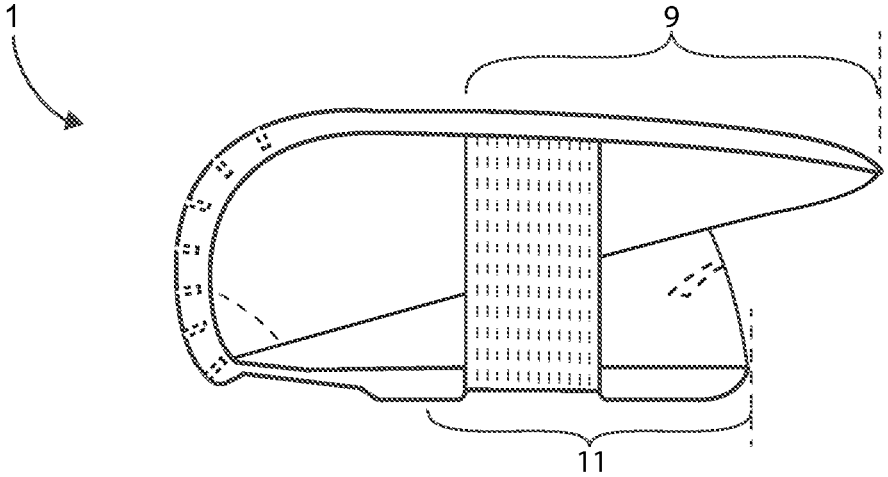
Figure 7:
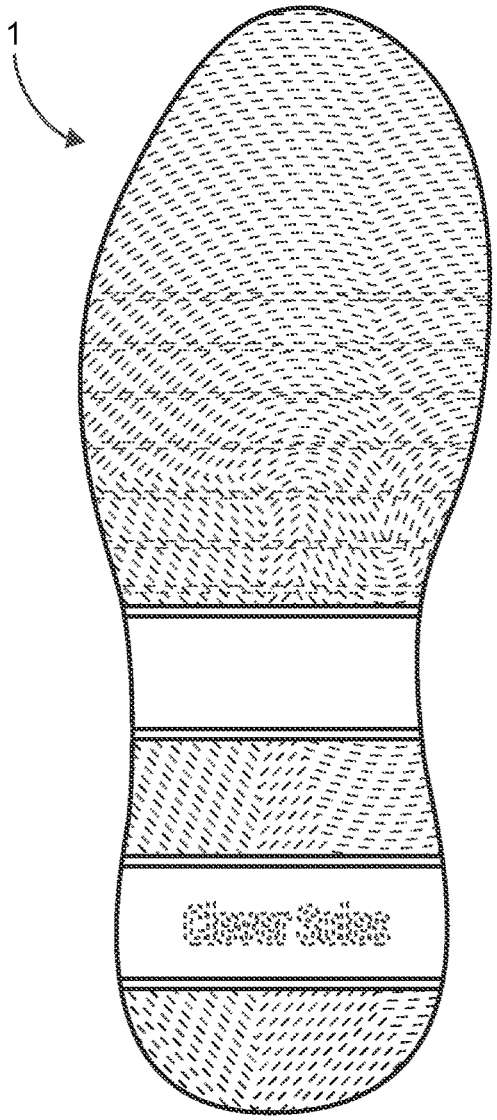
Figure 8:
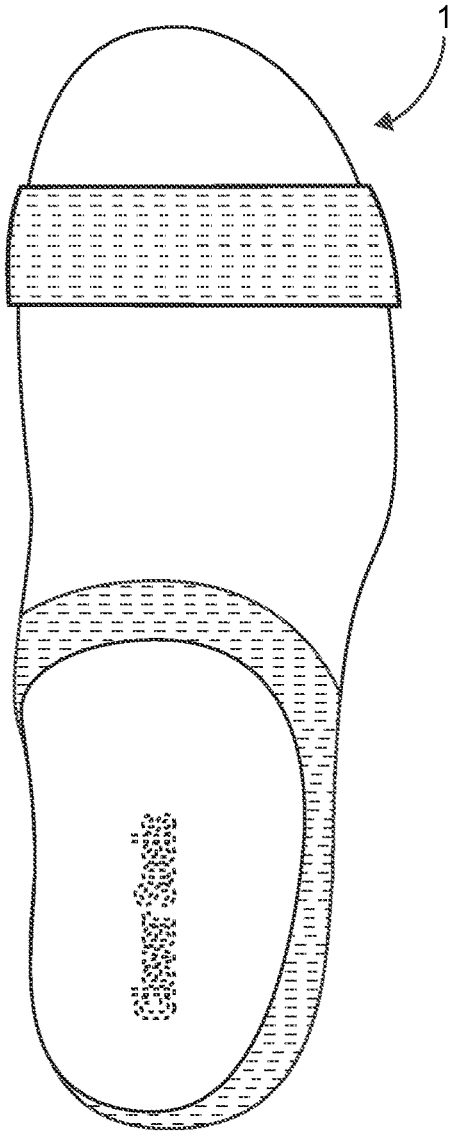
Figure 9:
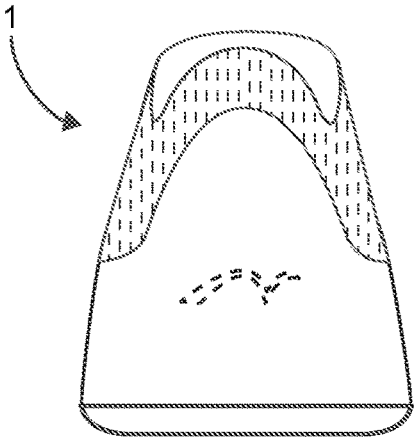
Figure 10:
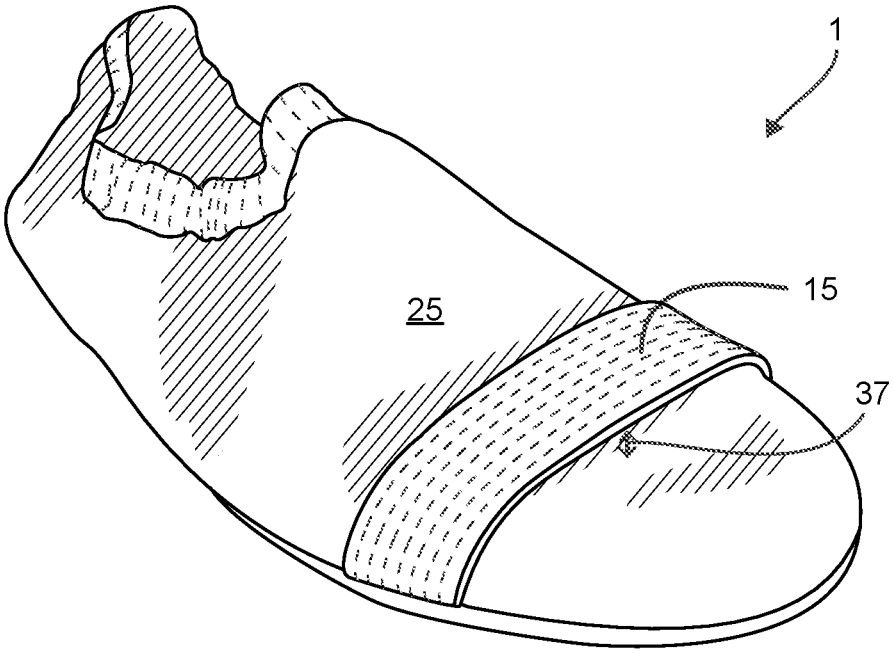
Figure 11:
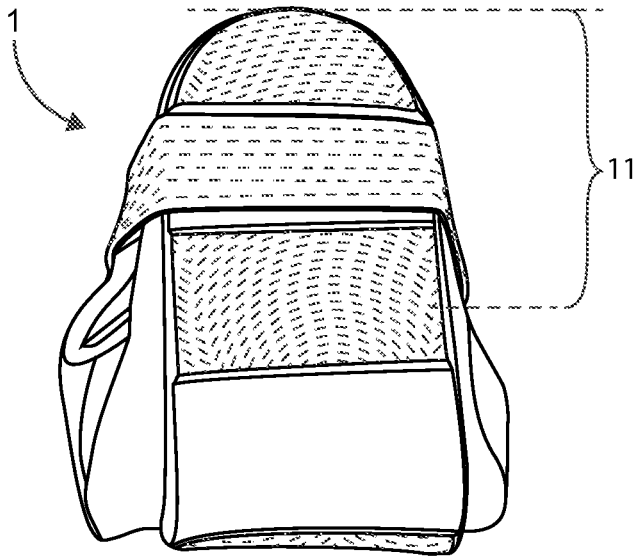

Having thus described the presently disclosed subject matter in general terms, reference will now be made to the accompanying Drawings, which are not necessarily drawn to scale, and wherein:

FIG. 1A is a close side elevation view of the instep side of a foldable shoe for a user's right foot, empty and not occupied by a foot;

FIG. 1B is a section view of the foldable shoe shown in FIG. 1A;

FIG. 2A is a close side elevation view of the instep side of a foldable shoe for a user's right foot, with a user's right foot inserted;

FIG. 2B is a section view of the foldable shoe shown in FIG. 2A;

FIG. 3 is a close side perspective view of a foldable shoe, in a folded arrangement, a retainment orientation;

FIG. 4 is a close side perspective view of a pair of foldable shoes, in a stacked arrangement, with a left shoe inverted and atop a right shoe, a retainment orientation;

FIG. 5A is a side elevation view of an outstep side of a foldable shoe;

FIG. 5B is a side elevation view of an instep side of a foldable shoe;

FIG. 6 is a side elevation view of a foldable shoe in a folded position, with the toeroom region atop the heel region;

FIG. 7 is a bottom plan view of a foldable shoe;

FIG. 8 is a top plan view of a foldable shoe;

FIG. 9 is a rear elevation view of a foldable shoe;

FIG. 10 is a front perspective view of a foldable shoe, empty of a foot of a user, and FIG. 11 is a top perspective view of a foldable shoe having a heel region and toeroom region, in a folded arrangement, with the heel of the shoe atop the toeroom region of the shoe.

DETAILED DESCRIPTION

The following detailed description is made with reference to the figures. Exemplary embodiments are described to illustrate the disclosure, not to limit its scope, which is defined by the claims. Those of ordinary skill in the art will recognize a number of equivalent variations in the description that follows.

Articles "a" and "an" are used herein to refer to one or to more than one (i.e. at least one) of the grammatical object of the article. By way of example, "an element" means at least one element and can include more than one element.

"About" is used to provide flexibility to a numerical endpoint by providing that a given value may be "slightly above" or "slightly below" the endpoint without affecting the desired result.

The use herein of the terms "including," "comprising," or "having," and variations thereof is meant to encompass the elements listed thereafter and equivalents thereof as well as additional elements. Embodiments recited as "including," "comprising," or "having" certain elements are also contemplated as "consisting essentially of" and "consisting" of those certain elements.

Recitation of ranges of values herein are merely intended to serve as a shorthand method of referring individually to each separate value falling within the range, unless otherwise indicated herein, and each separate value is incorporated into the specification as if it were individually recited herein. For example, if a range is stated as between 1%-50%, it is intended that values such as between 2%-40%, 10%-30%, or 1%-3%, etc. are expressly enumerated in this specification. These are only examples of what is specifically intended, and all possible combinations of numerical values between and including the lowest value and the highest value enumerated are to be considered to be expressly stated in this disclosure.

Unless otherwise defined, all technical terms used herein have the same meaning as commonly understood by one of ordinary skill in the art to which this disclosure belongs.

As will appear in the several drawings, below is a list of several elements indicated with a reference numeral.

1. foldable shoe
3. sole
5. toe end
7. heel end
9. toeroom region
11. heel region (of the sole)
13. midfoot region (of the sole)
15. strap
17. toe-lever region (of the sole), (of the toeroom region)
19. strap retainment recess
21. foot of a user
23. ball (of the user's foot)
25. upper (portion)
27. bending strength recess
29. bending enhancement recesses

31. stiffened portion (of the midfoot region)

33. bending enhanced portion (of the midfoot region)

35. ankle collar

37. gap (between upper portion and underside of strap)

Referring now to FIGS. 1A and 2A, what are shown are close side elevation views of the instep side of a foldable shoe 1 for a user's right foot. In FIG. 1A, the shoe 1 is empty and not occupied by a foot. In FIG. 2A, a user's foot 21 is shown inserted into the shoe 1. Specifically, there is a foldable shoe 1, comprising: a sole 3 extending between a toe end 5 and heel end 7, the sole 3 comprising a toeroom region 9 proximate the toe end 5 and a heel region 11 proximate the heel end 7 and a midfoot region defined between the toeroom region 9 and heel region 11.

The toeroom region 9 comprises a strap 15 spanning the width of the shoe 1 in a toe-lever region 17 of the toeroom region. The heel region 11 comprises at least one strap retainment recess 19 proximate the heel end 7, configured to alternately receive the strap 15 and retain the strap 15 against slipping off of the sole 3 and mitigate stress concentrations against breakage under the tensile strength of the strap 15 and bending strength of the sole 3, when the shoe is folded. The strap retainment recess 19 also alternately defines the compression strength of the sole 3 proximate the heel region 11, such that the shoe 1 is configured to alternately receive a foot 21 of a user with a ball 23 of the user's foot (See FIG. 2A, also 2B) retained in the midfoot region 9 with a stretchable upper portion 25 of the shoe 1 that is independent of the strap 15, and the shoe 1 alternatively folds into a retainment orientation (see FIG. 3).

Further embodiments disclosing side elevation views of foldable shoes are shown in FIGS. 5A-B. FIGS. 5A and 5B show additional (outstep and instep, respectively) side elevation views of contemplated embodiments of a foldable shoe 1.

Referring now to FIGS. 1B and 2B, what are shown are section views of the foldable shoes shown in FIGS. 1A and 2B, respectively. These section views are taken through the width of the shoes 1 shown in FIGS. 1A and 2A, respectively, through the toe-lever region 17 of the toeroom portion 9, to better compare details about the strap and the upper portion, 25.

Here, the strap 15 has a minimum unstretched length that spans an unstretched section length of the upper portion 25 of the toe-lever region 17 of the shoe 1. Thereby, as can be seen in FIG. 1B, the strap 15 leaves a gap 37 (see also FIG. 1A) between an underside of the strap 15 and the top of the upper portion 25 of the shoe 1 (in the toe-lever region 17), when the shoe is empty of a user's foot. One contemplated material suitable to provide an adequate strap 15 is elastic.

In FIG. 2B, unlike FIG. 1B, a foot of a user 21 is inserted into the shoe 1. The upper portion 25 is collapsible and flexible to be stretched and to expand upward, toward the strap 15, such that the upper portion 25 does not limit the compression distance of the strap 15, nor expansion distance. Thereby, the upper portion 25 of the shoe 1 is stretched to a stretched section length of the upper portion 25 in the toe-lever region 17. While the strap 15 still spans this stretched section length of the upper portion 25, there is no gap between the underside of the strap 15 and the top of the upper portion 25. By the insertion of the foot of a user 21, the gap (37, See FIGS. 1A and 1B) is reduced to approximately zero while the strap 15 remains at approximately the same minimum unstretched length.

Referring now to FIG. 3, what is shown is a close side perspective view of a foldable shoe 1, in a folded arrangement, a retainment orientation, as referred to, above. Specifically, in FIG. 3, the shoe 1 is alternately folded into a retainment orientation (relative to FIGS. 1A and 2A), with the heel region 11 retained in a parallel offset orientation to the toeroom region 9 with the strap 15. This occurs with the upper portion 25 of the shoe 1 contained between the toeroom region 9 of the sole 3 and the heel region 11 of the sole 3, with the strap 15 traversing under the sole 3 in the heel region 11 and the strap 15 retained in the strap retainment recess 19 against slipping along the sole 3.

To improve the packaging of the shoe 1 when folded, the midfoot 13 of the shoe 1 comprises a stiffened portion 31 (see also FIGS. 1A and 2A) of the sole 3 and a bending enhanced portion 33 (see also FIGS. 1A and 2A) of the sole 3.

Specifically, with regards to the stiffened portion 31, the midfoot region comprises a bending strength recess 27 configured to define the compression strength and bending strength of the sole 3 proximate the midfoot region 13, such that the sole 3 is configured to bend, forward of (towards the toeroom region 9) the midfoot region 13, between the bending strength recess 27 and the toe-lever region (17, see FIGS. 1A and 2A).

Specifically, in the bending enhanced portion 33, the midfoot region 13 comprises a plurality of bending enhancement recesses 29 configured to locally decrease the bending strength of the sole 3 proximate the midfoot region 13, such that the midfoot region 13 comprises a stiffened portion 31 proximate the heel and a bending enhanced region 33 proximate the toe-lever region (17, see FIGS. 1A and 2A).

Shown working together in FIG. 3, the bending enhanced portion 33 provides significantly more of the overall arc length of the bending deformation than the stiffened portion 31, especially compared to the relative lengths of the portions 31, 33, where they appear undeflected in FIGS. 1A and 2A.

Further contemplated embodiments in a folded orientation are shown in FIGS. 6 and 11. FIG. 6 shows a side elevation view of a foldable shoe 1 in a folded position, with a toeroom region 9 atop a heel region 11. FIG. 11 shows further views of a foldable shoe 1 having a heel region 11 and a toeroom region (not visible from this angle, see 9, FIGS. 1A, 2A, 3, 4, 6) in a folded arrangement, with the heel region 11 of the shoe atop the toeroom region (not visible from this angle, see 9, FIGS. 1A, 2A, 3, 4, 6) of the shoe 1.

Referring now to FIG. 4, what is shown is a close side perspective view of a pair of foldable shoes 1, in a stacked arrangement, with a left shoe 1 inverted and atop a right shoe 1, a retainment orientation. In at least one contemplated embodiment represented here, the shoe 1 is configured to opposed retainment to another instance of the shoe 1, opposed retainment being a retainment orientation in which the strap 15 of each shoe 1 is retained in the strap retainment recess 19 of the other of the shoes 1.

Specifically, and with even greater specificity to the embodiment shown in FIG. 4, the shoe 1 is configured to flattening, such that when two of the shoes 1 are inverted with respect to one another and brought into opposed contact between an upper portion 25 of the shoes, the strap 15 of each of the shoes is configured to engage the strap retainment recess 19 of the other of the shoes, and retain the shoes 1 together against the compression strength of the respective opposed shoe 1 and the compression strength of the upper portion 25 of its respective shoe's 1 toeroom region 9 and the upper portion 25 of the opposed shoe's 1 heel region 11.

In yet another statement defining an embodiment supported by FIG. 4, the shoe 1 is configured to be inverted with respect to the other instance of the shoe 1, and rotated about a vertical axis and brought into contact with the upper portions 25 of the shoes 1 between the respective soles 3, with the toe ends 5 arranged proximate the heel ends 7 of the other of the shoes 1, and wherein the strap 15 of each shoe 1 is configured to retain the shoes 1 together against the cumulative compression strengths of: the upper portion 25 of the particular shoe 1, the upper portion 25 of the other shoe 1, and the compression strength of the heel region 11 of the sole 3 of the other shoe 1, such that the shoe 1 is configured to flattening into a flattened pair of shoes by opposed retainment with the other of the shoes 1.

FIGS. 7, 8, and 9 show bottom plan, top plan, and rear elevation views of a foldable shoe 1 similar to shoes 1 shown in FIGS. 1A-4, respectively.

FIG. 10 is a front perspective view of a foldable shoe 1, similar to that shown in FIGS. 1-4, empty of a foot of a user (21, See FIGS. 2A-B), with a strap 15 above the top of an upper portion 25, and showing a gap 37 between the underside of the strap 15 and top of the upper portion 25.

While the embodiments have been described in connection with the various embodiments of the various figures, it is to be understood that other similar embodiments may be used, or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed is:

1. A foldable shoe, comprising:

a sole extending between a toe end and heel end, the sole comprising a toeroom region proximate the toe end and a heel region proximate the heel end and a midfoot region defined between the toeroom region and heel region, the toeroom region comprising a strap spanning the width of the shoe in a toe-lever region of the toeroom region, the heel region comprising at least one strap retainment recess, configured to alternately:

receive the strap and retain the strap against slipping off of the sole and mitigate stress concentrations against breakage under the tensile strength of the strap and bending strength of the sole, when the shoe is folded; and define the compression strength of the sole in the heel region, such that the shoe is configured to alternately:

receive a foot of a user with a ball of the user's foot retained in the midfoot region with a stretchable upper portion of the shoe that is independent of the strap; and fold into a retainment orientation, with the heel region retained in a parallel offset orientation to the toeroom region with the strap, with the upper portion contained between the toeroom region of the sole and the heel region of the sole, with the strap traversing under the sole in the heel region and retained in the strap retainment recess.

2. The shoe of claim 1, wherein:

the upper portion is collapsible and flexible to be stretched and to expand upward, toward the strap, such that the upper portion does not limit either the compression distance of the strap, nor expansion distance.

3. The shoe of claim 1, wherein:

the midfoot region comprises a bending strength recess configured to define the bending strength of the sole in the midfoot region proximate the heel region, such that the sole is configured to bend in the midfoot region, between the bending strength recess and the toe-lever region.

4. The shoe of claim 1, wherein:

the midfoot region comprises a plurality of bending enhancement recesses that are each configured to locally decrease the bending strength of the sole proximate the midfoot region, such that the midfoot region comprises a stiffened portion proximate the heel region and a bending enhanced region proximate the toe-lever region.

5. The foldable shoe of claim 1, wherein the strap is elastic.

6. The foldable shoe of claim 1, wherein the strap comprises a minimum unstretched length that spans an unstretched section length of the upper portion in the toe-lever region of the shoe and leaves a gap between an underside of the strap and the top of the upper portion of the shoe, in the toe-lever region, when the shoe is empty of a user's foot.

7. The foldable shoe of claim 6, and further wherein the upper portion of the shoe is configured to stretch to a stretched section length of the upper portion in the toe-lever region, when the foot of a user is inserted into the shoe, such that the gap is reduced to approximately zero while the strap remains at approximately the minimum unstretched length.

8. The shoe of claim 1, wherein:

the shoe is configured to opposed retainment to another instance of the shoe, opposed retainment being a retainment orientation in which the strap of each shoe is retained in the strap retainment recess of the other of the shoes.

9. The shoe of claim 8, and further:

the shoe is configured to be inverted with respect to the other instance of the shoe, and rotated about a vertical axis and brought into contact with the upper portions of the shoes between the respective soles, with the toe ends arranged proximate the heel ends of the other of the shoes, and wherein the strap of each shoe is configured to retain the shoes together against the cumulative compression strengths of: the upper portion of the particular shoe, the upper portion of the other shoe, and the compression strength of the heel region of the sole of the other shoe, such that the shoe is configured to flattening into a flattened pair of shoes by opposed retainment with the other of the shoes.

* * * * *